United States Patent [19]

West

[11] 3,935,397

[45] Jan. 27, 1976

[54] ELECTROSTATIC LOUDSPEAKER ELEMENT

[75] Inventor: Roger A. West, Salt Lake City, Utah

[73] Assignee: Electronic Industries, Inc., Minneapolis, Minn.

[22] Filed: Jan. 28, 1974

[21] Appl. No.: 436,937

[52] U.S. Cl. ..... 179/111 R

[51] Int. Cl.[2] ..... H04R 19/02

[58] Field of Search ..... 336/179, 186, 199, 208, 336/232; 179/111 R

[56] References Cited

UNITED STATES PATENTS

| | | | |
|---|---|---|---|
| 2,441,564 | 5/1948 | Combs | 336/208 |
| 2,542,733 | 2/1951 | Tritle et al. | 336/208 |
| 2,896,025 | 7/1959 | Janszen | 179/111 R |
| 2,982,888 | 5/1961 | Whearley | 336/208 |
| 3,267,968 | 8/1966 | Foll et al. | 336/208 |
| 3,432,785 | 3/1969 | Solmos | 336/208 |

FOREIGN PATENTS OR APPLICATIONS

| | | | |
|---|---|---|---|
| 423,707 | 11/1945 | Italy | 336/232 |
| 1,339 | 4/1926 | Australia | 336/208 |

OTHER PUBLICATIONS

"Polystyrene Applied to Radio Apparatus", R. L. Harvey et al., RCA Review, Oct. 1939, pp. 200–203.

*Primary Examiner*—Kathleen H. Claffy
*Assistant Examiner*—George G. Stellar
*Attorney, Agent, or Firm*—Merchant, Gould, Smith & Edell

[57] ABSTRACT

An electrostatic loudspeaker element including a diaphragm positioned between a pair of acoustically transparent wire grid electrode assemblies. In the preferred embodiment, each electrode assembly comprises a flat rectangular frame having a plurality of wire guiding slots on both sides. A wire whose diameter equals the depth of the slots is wound continuously around the frame in a helical pattern, and a dielectric spacer is adhesively attached to the frame across the slots to maintain the critical distance between the wire grid and the diaphragm. The frame is made of a material having a coefficient of thermal expansion equal to the wire.

8 Claims, 4 Drawing Figures

ELECTROSTATIC LOUDSPEAKER ELEMENT

BACKGROUND OF THE INVENTION

The present invention pertains generally to electrostatic sound reproducers, and more particularly to an improved structure for a wire grid electrode electrostatic loudspeaker element, which results in improved performance and lower production costs.

In the art of high fidelity sound reproduction, the electrostatic loudspeaker has received wide recognition because of its excellent sound quality and smooth and faithful response over wide frequency ranges. In such speakers, a flexible sound producing diaphragm is positioned near an electrode, or in the case of a push-pull arrangement, a pair of electrodes, one on either side of the diaphragm. A DC polarization potential is applied between the diaphragm and the electrodes, and the audio signal is superimposed thereupon, causing the diaphragm to move in response thereto. Of course, in a push-pull arrangement, it is necessary that one or both of the electrodes be acoustically transparent so that the sound produced by the diaphragm can radiate outwardly through the electrode to the listening area. Usually some type of conductive screen or grid is used for the electrode. The individual conductive elements are close enough together to collectively define an electrostatic plane, and the spaces between the elements of the screen or grid provide apertures for the passage of sound produced by the diaphragm.

One important type of electrode construction is the wire grid electrode, wherein a plurality of spaced parallel wire segments supported by a frame form the electrode. Although the wire grid electrode has many advantages from a performance and manufacturing point of view, certain problems must be overcome in design and manufacture if the full performance of the electrostatic speaker is to be realized. One of these problems involves controlling the critical distance between the plane of the wire grid and the diaphragm, as this distance affects the relative sound output of the finished unit. Since the wires are inherently somewhat flexible, any slack or buckling of the wires could cause them to touch the diaphragm, which would result in severe distortion, and possibly dielectric breakdown of the wire insulation. Another problem involves allowing for thermal expansion of the various components so that the wires are not allowed to become too tight or too slack when temperature changes occur.

One proposed solution to these problems is set forth in U.S. Pat. No. 2,896,025, issued July 21, 1959. In that patent, a wire grid electrode is made up of a plurality of insulated wires lying in slots cut in a generally rectangular plane which has a plurality of web members defining sound passing apertures. One end of each of the wires is electrically connected to a common bus bar, while the other end of each wire is free. The insulation on each length of wire is glued to the wire guide slots, but the wire is free to move axially of the insulation due to temperature effects.

Although the structure described in the aforementioned patent does provide a high quality electrostatic loudspeaker element, it is subject to a number of problem areas which are overcome by the present invention. One problem is the difficulty of accurate control of the critical distance between the electrostatic plane defined by the wires, and the diaphragm. In the prior art apparatus represented by U.S. Pat. No. 2,896,025, it has been found that significant variations in this critical distance occur in manufacturing, causing variations in the sound output level from one unit to another, thus necessitating individual testing and matching. Another problem is that if any of the glue used to attach the wire insulation sheaths to the frame should happen to touch the free ends of the wires, the wire will be unable to slide back and forth during temperature changes, and this could cause the wire to buckle and touch the diaphragm. Another problem is that a number of the manufacturing steps, such as individually soldering the wire elements to the bus bar, and applying glue to the wires in the slots take an undue amount of time and result in a high production cost.

The present invention provides an improved wire grid electrostatic speaker element which overcomes these and other problems existing in the prior art. In the present invention, the frame is molded from a carefully chosen material having thermal expansion which equals that of the wire. The wire is thus wound continuously around the frame without any need for cutting or soldering to a bus bar. Accurate temperature compensation and reduced production costs are thereby achieved. Further, a dielectric spacer element is positioned between the wire grid and the diaphragm to accurately control the critical distance therebetween. In the preferred embodiment, the spacer element is double coated with a pressure sensitive adhesive for ease in assembly. In addition to lower production costs, the present invention provides an electrostatic dust shielding effect which keeps dust out of the diaphragm area.

SUMMARY OF THE INVENTION

Accoroding to the present invention there is provided a wire grid electrode assembly for an electrostatic loudspeaker comprising an acoustically transparent frame having a plurality of wire guiding slots. A wire is wound continuously around the frame in the slots to form a wire grid. A dielectric spacer member is attached to the frame across the wire guiding slots to confine the wire within the slots, and to control the spacing between the wire grid and an electrostatic diaphragm against which the electrode assembly may be placed. The frame is made from a material having a coefficient of thermal expansion equal to that of the wire, so that buckling or change in tension of the wires as a function of temperature is prevented.

The present invention also provides an electrostatic loudspeaker element made up of a pair of these wire grid electrode assemblies, with a flexible diaphragm placed between the dielectric spacer members of the two electrode assemblies, to form a completed, push-pull unit.

DESCRIPTION OF THE PREFERRED EMBODIMENT

Figure 1:
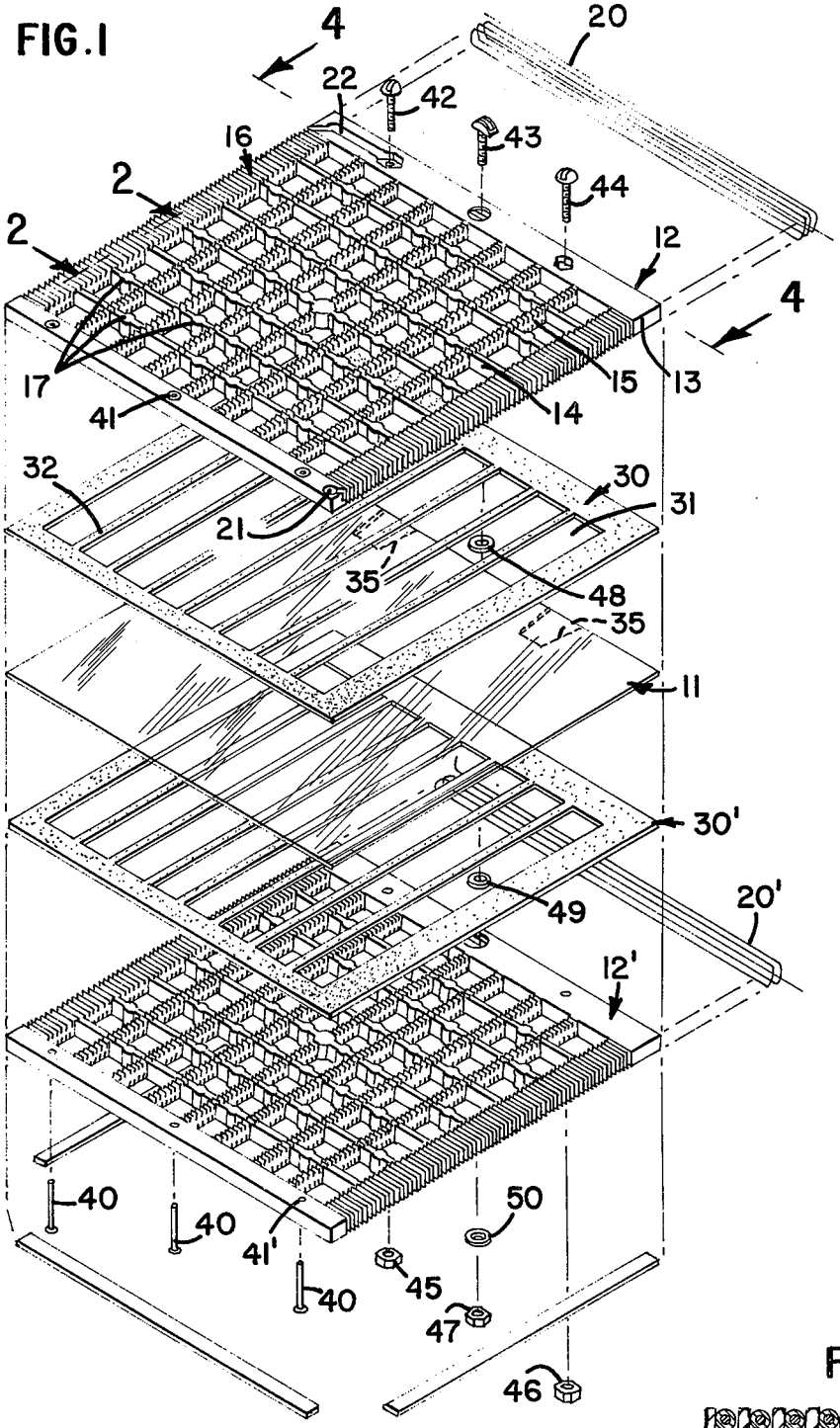
FIG. 1 is an exploded perspective of an electrostatic loudspeaker element according to the present invention.

The electrostatic loudspeaker element shown in FIG. 1 is designed to reproduce the mid-range and high frequency portions of the audio spectrum. Although the structural principles according to the present invention are applicable to loudspeaker elements having various sizes and shapes to cover any desired frequency range, the preferred embodiment shown in the drawings is designed to reproduce sounds from several hundred hertz to beyond the upper limit of high fidelity sound reproduction, at about twenty kilohertz. The assembled unit of FIG. 1 measures approximately five inches square, and may be used with an array of several identical units facing in slightly different directions to provide optimum sound dispersion. Such an array of electrostatic elements is suitable to provide mid-range and high frequency reproduction, when mounted in a speaker cabinet which contains a conventional cone-type loudspeaker for reproducing the lower end of the audio spectrum.

As shown in the exploded view of FIG. 1, the electrostatic loudspeaker element basically comprises a flexible diaphragm 11 which is sandwiched between a pair of wire grid electrode assemblies to form a push-pull electrostatic element. In FIG. 1, the two electrode assemblies are those elements respectively above and below the diaphragm 11. Since these two electrode assemblies are identical, the description which follows is directed towards the upper electrode assembly, but is equally applicable to the lower one. Corresponding parts in the lower electrode assembly are given primed numbers corresponding to the upper electrode numbers for the same parts.

A generally flat, square frame 12 is provided for the electrode assembly. Frame 12 has an outer border portion 13 and a plurality of interior web members, two of which are numbered 14 and 15, by way of example. A number of the web members are parallel to web 14, and the remainder are parallel to web 15, the two sets of web members being mutually perpendicular. For convenience, all web members running parallel to web member 14 will be given the reference number 14, and all web members parallel to web member 15 will be referred to by reference number 15. A plurality of wire guiding slots, one of which is given reference number 16, are formed along two edges and along the web members 15. These wire guiding slots are formed on both sides and two edges of the frame to form a continuous helical path, as can be seen with reference to frames 12 and 12'. Preferably, the frames are molded so that the two frames are identical, and frame 12' is inverted with respect to frame 12 in FIG. 1, so that the same side of both frames will face towards the diaphragm 11. A plurality of knobs or widened spots are provided in web members 14, one of which is indicated by reference number 17. These knobs are used in the molding process which forms the frame by providing surfaces for ejecting the finished frame from the mold. Otherwise, they perform no other function in the construction and operation of the loudspeaker element.

It will be observed that the web members 14 and 15 define a plurality of sound passing apertures therebetween. These apertures make frame 12 acoustically transparent which of course is necessary in order that the sound produced by diaphragm 11 may radiate outwardly to the listening area. The web members 14 are made slightly smaller in height than the slotted web members 15, so that the web members 14 will not interfere with the wire which is to be placed in the wire guiding slots. This clearance also prevents a buzzing sound that could arise from slight motions of the wire causing slapping against member 14. The wire guiding slots 16 comprise notch portions separated from one another by flange portions. These slots are configured to provide a generally continuous helical path around the frame from one end to the other.

An insulated wire 20 is wound continuously around the frame 12, in a general helical path. In the exploded view of FIG. 1, wire 20 is shown for purposes of clarity off to the side of frame 12. In making the electrode assembly, the winding process may be done, for example, by machine, as is well known in the prior art. One end of the wire may be secured in the beginning slots 21 by suitable means such as melting some of the plastic of the frame over the end of the wire with a soldering iron. Winding of the wire then proceeds around frame 12 through all the slots, ending at the final slot 22, where the end of the wire may be likewise secured. During the winding process, the wire should be kept taut so that it lies straight across the face of the frame and bends smoothly around the edges.

Since the wire 20 is wound completely around frame 12 a number of times, it is important that the temperature expansion and contraction characteristics of the frame and the wire are very closely matched. Otherwise, differential expansion or contraction could cause the wires to go slack or to buckle which might allow them to touch the diaphragm, creating audible distortion and the possibility of high voltage breakdown. In order to meet this objective, the frame 12 is preferably molded from a mixture comprising 60% polystyrene and 40% glass.

A dielectric spacer member 30 is provided between electrode frame 12 and diaphragm 11. Spacer 30 is preferably the same outside size as frame 12, and it has a plurality of elongated openings 31 which are separated by a plurality of strips 32. The openings 31 align with the sound passing apertures in the frame 12, and the strips 32 are aligned with the web members 15 which contain the wire guide slots.

The spacer element is coated on both sides with a pressure sensitive adhesive. One adhesive coating which has been found to work well is coating No. 467 of the 3M Company. The spacer is pressed in place against frame 12, across the wire guiding slots to confine the wires in place.

The spacer element performs two functions: it provides a precise spacing between diaphragm and electrodes, and it assists in assembly because the pressure sensitive adhesive holds the diaphragm 11 in its stretched condition to the frame 12, and holds the wire 20 captive in the slots. From an electrical standpoint, the spacer acts as a dielectric since it appears between the two speaker grids, which are in effect capacitor plates. The dielectric constant of the material used for spacer element 30 should be kept as low as possible to reduce the shunting effect of the dead capacitance, or non-sound producing areas, such as under or between the margins of the frame and along web members 15. Suitable materials for spacer element 13 are polyethylene, polypropylene and polystyrene.

The material used for diaphragm 11 should have high flexibility or compliance, good chemical and mechanical stability with age, and low mass, since this affects the high frequency cut off point. A number of materials are useable for diaphragm 11. One material is Saran film made by Dow Corning, and made conductive by rubbing the film with graphite. Mylar and polypropylene coated with a vacuum deposited aluminum film several millionths of an inch thick also works well. Polypropylene and polyethylene have about the lowest specific gravity. A film one-quarter mil thick will provide high frequency response to nearly 50 kilohertz.

Figure 2:
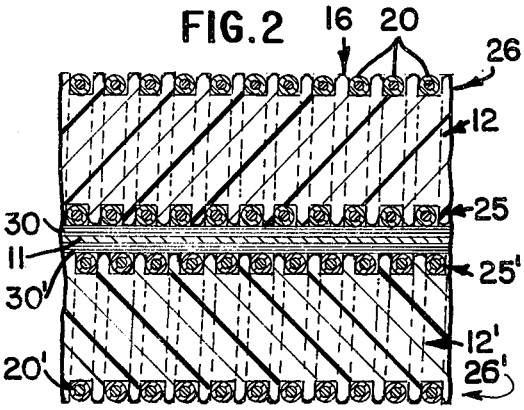
FIG. 2 is a sectional view taken generally along a line 2—2 of FIG. 1 in the assembled position.

After the spacer 30 is attached to the wound electrode frame 12 to form a completed electrode assembly, the diaphragm 11 is placed under tension prior to attachment to the other adhesive face of spacer 30. Proper tensioning of the diaphragm can be accomplished by starting with a diaphragm larger than needed, which can later be trimmed to the finished size. The diaphragm is stretched in a frame in the presence of an acoustic field of about 50 to 60 hertz produced by a loudspeaker. The tension is adjusted until the diaphragm resonates in response to this acoustic field. The diaphragm is then secured to the adhesive coating on spacer 30, and any excess size of the diaphragm may be trimmed. Also at this time a pair of notches indicated by dotted lines 35 may be cut out, so that bolts 42 and 44, which are assembled later, will not contact the diaphragm. The other electrode assembly comprising frame 12', wire 20', and spacer 30' is then adhered to the other side of diaphragm 11 to form the completed unit. The cross-sectional view of FIG. 2 shows the relationships of the various components in the final assembly. FIG. 2 is taken across the wire guiding slots so as to show a zone in which the diaphragm is clamped between the spacers 30 and 30'. However, it will be appreciated that the slotted web members 15 and the strips 32 will effectively divide diaphragm 11 into a plurality of elongated zones which are individually free to vibrate under influence of the applied electric field to thereby produce the sound. These elongated zones, which have a length-to-width ratio of about eight to one are for insuring static stability of the diaphragm, so that it will not collapse into an electrode under an applied voltage.

Figure 3:
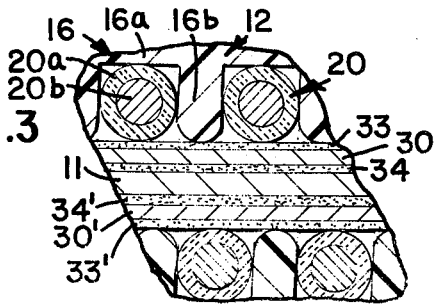
FIG. 3 is an enlarged fragmentary detail of a portion of FIG. 2.

In FIG. 2, the wire guiding notches 16 on both surfaces of frame 12, and also of frame 12', are more clearly seen. The successive turns of wire 20 define two separate wire grids, one along the upper surface of frame 12, and another along the lower surface, near the diaphragm. The wrapping of wire 20 around the end of the frame is indicated by the dotted lines. Dielectric spacer member 30 is shown lying across the wires and the slots, and the diaphragm 11 is held in place between spacers 30 and 30'. FIG. 3 even more clearly shows the relationships near the diaphragm. In FIG. 3, it is seen that each wire guiding slot comprises a notch portion **16*a* and a flange portion 16*b* which separates successive notch portions. The wire 20 has an inner copper conductor 20*b* and an insulative coating 20*a*. The width of the notch 16*a* or the height of the flange portion 16*b* is substantially equal to the outside diameter of the wire insulation 20*b*. The corners of the flanges are slightly rounded so that the wire will not hang up on a sharp edge during high speed winding. If there are to be variations due to manufacturing tolerances, it is preferable that the wire diameter be slightly larger than the flange 16*b*, so that the wire will be in contact with the adhesive coating on the spacer. The spacer 30 has a first adhesive coating 33 which is seen to contact the flange portions 16*b* of the wire guiding slots, and also the outer insulation 20*b* of the wires themselves. The other side of spacer 30 has a coating 34 which attaches to the diaphragm 11. Thus, it will be seen that the individual turns of wire 20 are held securely in place within the wire guiding slots, and the critical distance between the wire 20*a* and the diaphragm 11** is precisely controlled by the spacer member.

In the preferred embodiment, the diaphragm is one-quarter mil thick metalized polypropylene. The spacer is 0.0075 inches thick, and the thickness of each adhesive layer on the spacer is 0.0025 inches. The wire is No. 28 gauge solid tinned copper, 12.5 mils in diameter. The wire insulation is six mils thick. The insulation is controlled leakage polyvinyl plastic. The insulation must have somewhat "leaky" characteristics in order to be able to get rid of charge that is pulled into its molecular lattice structure during exposure to extremely high electric fields. If this charge were not immediately removed, it would create a counter-bias resulting in a temporary loss of sensitivity until the charge leaks off. In the preferred embodiment, the leakage of the wire insulation is such that the charge will leak off in about 0.05 seconds. Very high insulation materials might require up to an hour to leak off.

Figure 4:
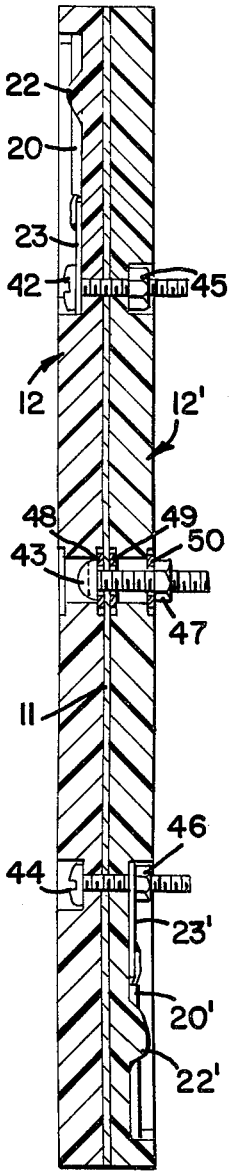
FIG. 4 is a sectional view taken generally along a line 4—4 of FIG. 1 in the assembled position.

Referring again to FIG. 1, after the two electrode assemblies and the diaphragm 11 are assembled together, a plurality of rivets 40 may be inserted through holes 41 and 41' which were previously molded in the frame members. The rivets are punched through the spacer members and diaphragm and secured at the other end to provide additional strength and compression on the wires, spacers and diaphragm to maintain them in proper relationship. Bolts 42, 43 and 44 are inserted through holes provided for that purpose at the other end of the frames to perform the dual function of holding the assembly together, and providing electrical contact terminals for the two wire grids and the diaphragm. The head of bolt 42 sets in a recess at the widened end of an enlarged slot which connects to point 22 at the end of the winding. As shown in FIG. 4, the end of wire 20 lies in this elongated slot and is held in place by the melt of plastic at point 22, as previously explained. The end of wire 20 is soldered to a clip 23 which fits under the head of bolt 42 to provide the electrical connection to wire 20. A nut 45 is threaded onto bolt 42 and seats in a matching recess provided in frame 12'. The protruding end of bolt 42 may be used as the electrical terminal for the wire grid electrode.

In similar manner, wire 20' is held in place at point 22' and is soldered to a clip 23' on the other electrode. This clip is held in electrical contact by bolt 44 and nut 46. The protruding end of bolt 44 provides the electrical terminal for the other wire grid electrode. Bolts 42 and 44 do not make electrical contact with diaphragm 11, since portions indicated by dotted lines 35 were previously cut away near the bolt holes.

Washers 48 and 49, which had previously been placed in slight recesses in frames 12 and 12', provide the electrical contact with diaphragm 11. Bolt 43 is inserted through washers 48 and 49, punching out the small central portion of the diaphragm, and is secured by washer 50 and nut 47. The extended end of bolt 43 provides the electrical connection to the diaphragm. It will be noted that due to the recessed hex nut sockets, one-handed assembly of all three bolts is possible, thus resulting in further simplified assembly.

Referring again to FIG. 2, the wires 20 and 20' each define two different wire grids. The inner wire grids lie in planes generally designated 25 and 25'. The outer wire grids lie in planes generally designated 26 and 26'. Of course it is the inner wire grids lying in planes 25 and 25' which, together with diaphragm 11, provide the high voltage electrostatic field for operation of the speaker. The outer wire grids lying in planes 26 and 26' are too far away from the diaphragm to have any such effect, but it has been found that they provide an additional advantage. In operation, when the diaphragm is charged positively and wires 20 and 20' are charged negatively, it has been found that the outer wire grids lying in planes 26 and 26' form electrostatic dust shields which effectively prevent dust from entering the sound passing apertures and settling on the diaphragm. This electrostatic dust shield effect assumes that the dust in the air is negatively ionized, which is usually the case. Most actual dust accumulation occurs when the speaker is not reproducing sound — that is when the DC supply is on but no AC signal is applied. Therefore, the DC bias supply to the wire grids is preferably made negative so that dust will be repelled. In practice, a nominal DC bias of minus 1200 volts is preferred. The magnitude of this bias is greater than the largest peak of the AC signal which is to be applied, so that the wire grid never goes positive. This insures that the negatively charged grid will continue to repel negatively ionized dust particles.

What is claimed is:

1. An electrostatic loudspeaker element, comprising:

a. first and second electrode assemblies, each having:

1. a frame having a generally planar face and having a plurality of web members defining sound passing apertures therebetween, said frame having a plurality of generally parallel wire guiding slots formed in said web members along the face of said frame;

2. a wire wound around said frame in said wire guiding slots to form a wire grid electrode along the plane of the face of said frame;

3. said frame made of material having a coefficient of thermal expansion substantially equal to that of said wire;

4. a dielectric spacer member attached to the face of said frame and having openings aligned with the apertures in said frame and having strip portions aligned with said web members and in contact therewith to confine said wire to said slots;

b. a diaphragm; and c. means for positioning said diaphragm between said first and second electrode assemblies adjacent said spacer members, whereby said spacer members maintain constant spacing between said wire grid electrodes and said diaphragm, and maintain said wires in position along the planes of the faces of the respective first and second electrode assembly frames.

2. Apparatus according to claim 1 wherein said frame is generally planar in configuration having slots on both sides and including means for fastening the ends of said wire to said frame.

3. Apparatus according to claim 1 wherein said frame is made of glass-filled polystyrene.

4. Apparatus according to claim 1 wherein said diaphragm is made of metalized polypropylene.

5. Apparatus according to claim 1 wherein said dielectric spacer members have pressure sensitive adhesive coatings on both sides for attachment to said frame and to said diaphragm.

6. Apparatus according to claim 1 further including electrical terminals on the two said frames, along the edge thereof, and electrically connected to said wires and said diaphragm.

7. Apparatus according to claim 1 wherein said wire is insulated, and wherein the depth of said wire guiding slots is substantially equal to the outside diameter of the wire insulation.

8. Apparatus according to claim 7 wherein said wire insulation comprises limited leakage poly-vinyl.

* * * * *